United States Patent [19]

Romo

[11] Patent Number: 4,640,265

[45] Date of Patent: Feb. 3, 1987

[54] INSERT FOR CONVERTING A CONVENTIONAL HOME OVEN INTO A PIZZA OVEN

[76] Inventor: H. Duane Romo, 7105 - 156th SW., Edmonds, Wash. 98020

[21] Appl. No.: 832,850

[22] Filed: Feb. 24, 1986

[51] Int. Cl.[4] ..... F24C 15/16

[52] U.S. Cl. ..... 126/337 R; 126/19 R; 126/273 R; 126/273.5; 99/447

[58] Field of Search ..... 126/19 R, 273 R, 332, 126/337 R, 337 A, 339, 375, 273.5, 246; 99/422, 447, 340, DIG. 15

[56] References Cited

U.S. PATENT DOCUMENTS

| | | | |
|---|---|---|---|
| 1,940,172 | 12/1933 | Hybinette | 219/19 |
| 2,040,996 | 5/1936 | Hungerford | 126/339 |
| 2,640,478 | 6/1953 | Flournoy | 126/375 |
| 2,718,854 | 9/1955 | Michaelis | 126/337 R |
| 3,550,580 | 12/1970 | Wong | 126/337 R |
| 4,184,421 | 1/1980 | Ahlgren | 99/450 |
| 4,258,695 | 3/1981 | McCarton et al. | 126/375 |
| 4,378,005 | 3/1983 | Otto | 126/246 |

FOREIGN PATENT DOCUMENTS

| | | | |
|---|---|---|---|
| 2550321 | 2/1985 | France | 99/422 |
| 2093984 | 9/1982 | United Kingdom | 126/337 R |
| 2099989 | 12/1982 | United Kingdom | 126/337 R |

*Primary Examiner*—Margaret A. Focarino
*Attorney, Agent, or Firm*—Delbert J. Barnard

[57] ABSTRACT

A plurality of ceramic oven tiles (36) are supported on a metal frame (10) and the frame is supported in an oven on an oven rack (38) the frame (10) has an angle construction on all four sides. The two sides and the rear comprise upstanding walls (14, 16, 18) and inwardly extending walls (22, 24, 26) on which the tiles (36) are supported. The front has a vertically depending front wall (20) and an inwardly directed wall (28) on which front portions of the tiles (36) are supported. The front wall (20) functions to stiffen the front of the frame (10), and contributes to the overall stiffness of the frame (10). It rests against the front edge (40) of the oven rack (38), and in this manner positively positions the frame (10) on the oven rack (38). Wall (20) also functions as a handle for the frame (10). The frame (10) is constructed from sections of angle metal and metal strips, secured together by spot welding or rivets, or is a one-piece casting.

14 Claims, 5 Drawing Figures

Fig. 3
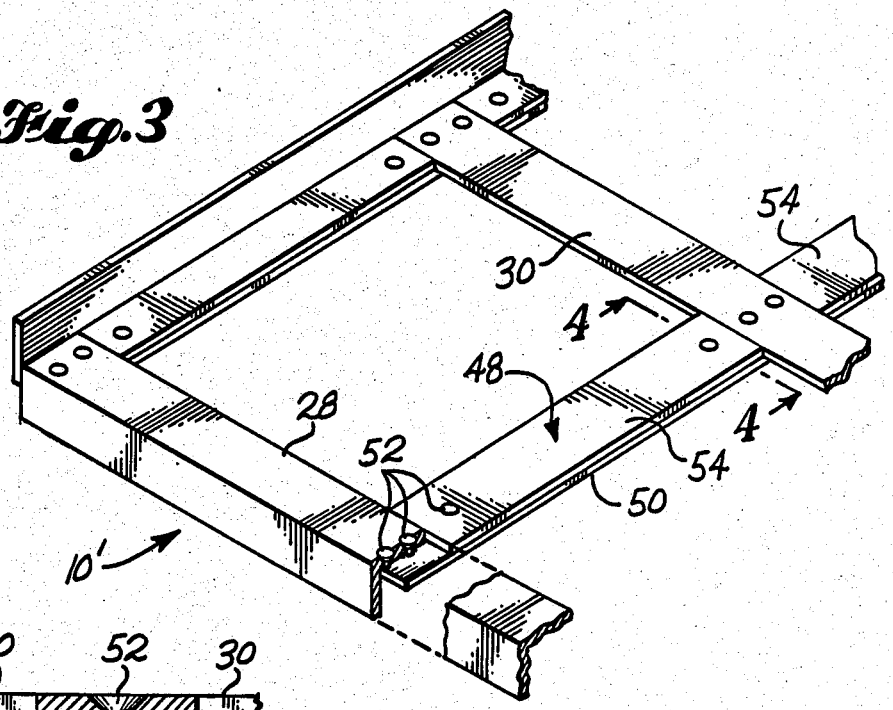
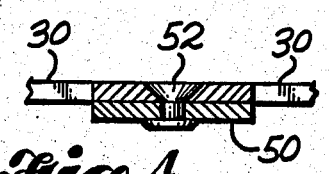
Fig. 4
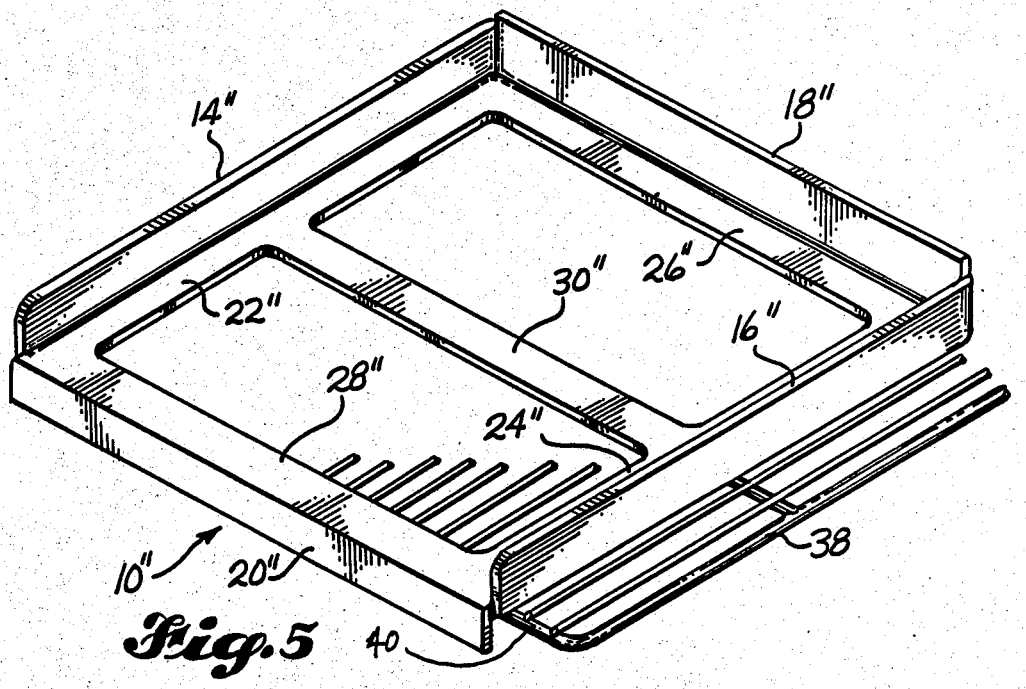
Fig. 5

INSERT FOR CONVERTING A CONVENTIONAL HOME OVEN INTO A PIZZA OVEN

DESCRIPTION

1. Technical Field

This invention relates to oven cooking of pizza and like edibles. More particularly, it relates to the provision of an insert for a conventional home oven which provides the oven with a ceramic oven tile surface on which pizza and similar type edibles are cooked.

2. Background Art

Pizza cooked at home in a conventional oven lacks the crust quality of a pizza cooked in the average pizza parlor. This is because cooking on the standard wire oven rack tends to produce dried out, hard crust which is barely edible. If the pizza is placed directly on the wire rack, cheese on the pizza which melts during cooking can drip onto the rack and through the rack onto the bottom of the oven. Once cooked, the cheese is nearly impossible to remove from the rack and/or oven bottom. Some people place the pizza on a cookie sheet. This tends to produce a pizza crust that is too soft and is undercooked.

Commercial pizza ovens have ceramic oven tile bottoms on which the pizza is placed. It is a principal object of the present invention to provide an insert for a conventional household oven which provides the oven with a ceramic oven tile support for the pizza.

DISCLOSURE OF THE INVENTION

The oven insert of the present invention is basically characterized by ceramic oven tile means on which a pizza to be cooked is supported, and a support frame for the ceramic oven tile means. The frame is rectangular and includes upstanding sidewalls, an upstanding rear wall, a depending front wall, and bottom wall portions bordering each of the side, rear and front walls. The ceramic oven tile means is supported on the bottom wall portions of the frame. In use, the insert is positioned in an oven on a wire oven rack. The bottom wall portions of the frame set down on the wire rack. The depending front wall of the frame is situated forwardly of the front edge portion of the wire rack.

All four sides of the rectangular frame are angle sections. The side and rear sections have upwardly directed sidewalls and inwardly directed bottom walls. The front section has an inwardly directed bottom wall and a downwardly directed front wall.

In accordance with the invention, the front wall stiffens the front section of the frame and contributes to the stiffness of the entire frame. It also functions as a stop, to limit rearward movement of the frame on the oven rack. It further functions as a handle, usable when it is desired to move the frame into and out from the oven.

In accordance with one aspect of the invention, the frame is constructed from individual members which are secured together in any suitable manner. In accordance with another aspect of the invention, the frame is cast in one piece.

In preferred form, the ceramic oven tile means comprises a plurality of tile members positioned on the endwardly directed bottom wall portions of the frame, with the inner edges of the tiles together, and with the outer edges adjacent the side, rear and front walls of the frame.

The ceramic oven tile members function to absorb heat in essentially the same manner as a tile bottom of a conventional pizza oven. Dripping of melted cheese, etc., on the tile members is not a problem. The individual tile members can be easily cleaned after they have cooled.

Other more detailed features of the invention are described in the description of the best mode of the invention and are particularly pointed out in the appended claims.

BRIEF DESCRIPTION OF THE DRAWINGS

In the drawings, like element designations refer to like parts throughout, and:

FIG. 3 is a fragmentary isometric view of a modified construction of the frame, such frame including an intermediate bottom wall portion which extends from the front to the rear of the frame, an also showing the use of doubler strips for providing bottom portions having upper surfaces which are all coplanar, so that the ceramic oven tile means is supported on coplanar surfaces;

FIG. 4 is a cross-sectional view taken substantially along line 4—4 of FIG. 3, showing the use of a flush-topped pop rivet for securing the bottom portion-forming members together; and FIG. 5 is an isometric view of yet another modified form of frame, such frame being a one-piece cast member.

BEST MODE FOR CARRYING OUT THE INVENTION

Figure 1:
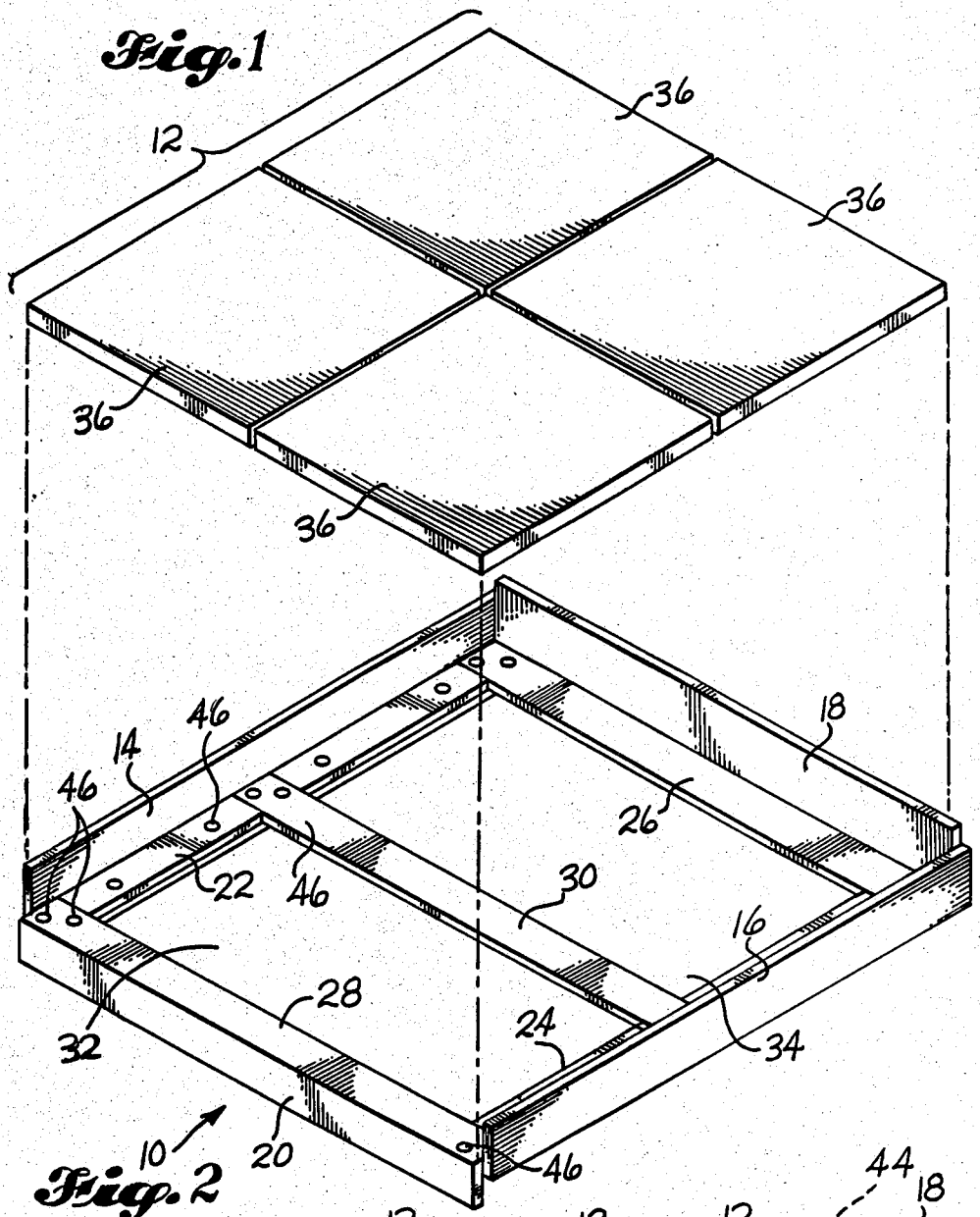
FIG. 1 is an isometric view of an oven insert of the invention, such view looking from above and towards the front and one side of the oven insert, showing ceramic oven tile members spaced in position above a support frame.

Referring to FIG. 1, the oven insert of the present invention comprises a rectangular frame 10 and ceramic oven tile means 12 which sets on and is supported by the frame 10.

Herein the term "rectangular" is used to mean a figure having four sides and four right angles. The term may include a figure having four equal sides (i.e. a square) as well as a figure having two sides and two ends which are shorter than the sides.

Figure 2:
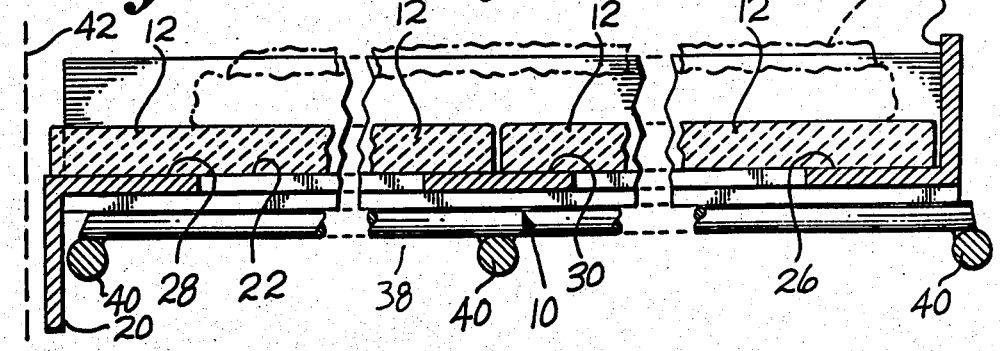
FIG. 2 is a framentary sectional view taken through the oven insert, from the front to the rear of the insert, such view showing the frame in a supported position on a wire oven rack, showing the tile members in section, and showing a pizza supported on the upper surface of the tile members.

Referring to FIGS. 1 and 2, the frame 10 comprises upstanding sidewalls 14, 16, an upstanding rear wall 18, and a depending front wall 20. Bottom wall portions 22, 24, 26, 28 border each of the walls 14, 18, 16, 20.

The frame includes at least one open area that is defined by and between the bottom wall portions 22, 24, 26, 28. In the embodiment shown by FIGS. 1 and 2, an intermediate bottom wall portion 30 extends from side to side of the insert. Thus, this embodiment has two open areas 32, 34.

In preferred form, the upper surfaces of the bottom wall portions 22, 24, 26, 28, 30 are all flush or coplanar.

The ceramic oven tile means 12 may comprise a plurality of tile members 36 which are placed on the frame 10 in an edge-to-edge relationship, with the side outer edges of the tiles 36 positioned adjacent the inside surfaces of the sidewalls, 14, 16, and the rear edges of the rear tiles 36 situated adjacent the rear wall 18. The front edges of the front tiles 36 are substantially flush with the front surface of front wall 20.

As shown by FIG. 2, in use the insert sets on and is supported by a wire oven rack 38. Specifically, the frame 10 sets down on the rack 38, and the front wall 20 is situated forwardly of the front edge 40 of the rack 38. As shown by FIG. 2, the front wall 20 actually depends downwardly below the front edge 40 of the rack 38. Thus, the front wall 20 performs three functions. Firstly, it is a stiffener for the front portion of the frame 10, i.e. it is an angle leg which extends perpendicular to the bottom wall portion 28, stiffening such bottom wall portion 28 and contributing to the overall stiffness of the frame 10. Secondly, it serves as a stop member for the frame and helps orient the insert in the oven. The user merely sets the insert onto the rack 38, and then pushes rearwardly until wall 20 contacts the front edge 40 of the rack 38. When contact is made the insert is fixed in position in the front to rear direction in the oven, and is ready to be removed. Thirdly, the front wall 20 serves as a handle to be used when it is desired to remove the insert from the oven. The user can easily grasp (by use of a hot pad) the lower edge portion of wall 20, and then pull out on the wall 20 until enough of the side portions of the frame are accessible so that the frame can be gripped on the sides, or on one side and the front, and then picked up and removed from the oven.

FIG. 2 shows that when the insert is in the oven, on the rack 38, the front wall 20 is spaced rearwardly from the oven door 42. Thus, conventional home ovens are constructed to provide a sufficient amount of space between the front edge 40 of the oven rack 38, and the oven door 42, for reception of the wall 20.

FIG. 2 shows a pizza 44 resting on the ceramic oven tile means 12, and shows the ceramic oven tile means 12 supported on the bottom wall portions of the frame.

In accordance with an aspect of the invention, the frame 10 is constructed from metal angle members. By way of typical, and therefore nonlimitive example, aluminum angle members may be used, measuring one inch by one inch by one-eighth inch.

When angle members are used, the frame 10 may be easily and conveniently manufactured by setting the end portions of the inwardly directed legs of the rear angle member onto the end portions of the inwardly directed legs of the side angle members. At the front of the frame 10, the end portions of the inwardly directed leg of the front angle member may be set down onto the front end portions of the inwardly directed legs of the side members. The intermediate bottom portion 30 may be constructed by extending a strip of metal equal in thickness to the angle member legs (e.g. one-eighth of an inch), with its end portions set down onto intermediate regions of the inwardly directed legs of the side angle members. Similar strips of material may be placed on those portions of the inwardly directed legs of the side angle members which are situated between the inwardly directed legs of the front and rear angle members and the strip 30. The various members which have been set onto each other may be joined together by spot welding 46, for example.

FIG. 3 discloses a slightly modified construction of the frame 10'. In this embodiment, a front-to-rear extending bottom wall portion 48 is provided. It is constructed by extending a strip of material like strip 30 in FIG. 1 (e.g. measuring one-eighth of an inch thick by one inch wide), with its end portions positioned under the inwardly directed legs of the front and rear angle members which form the bottom wall portions 28, 26. Spot welding (as described above), or pop rivet 52, are used for securing the ends of the member 50 to the members 26, 28. Short strips 54 may be set down onto the regions of member 50, between member 28 and member 30 and between member 30 and member 26. These strips 54 may be secured to the strip 50, also by the use of spot welding or pop rivets 52, for example.

FIG. 4 shows a member 54 connected to strip 50, by means of a pop rivet 52, with bottom portion 30 shown in the background.

In accordance with another aspect of the invention, the frame 10'' may be cast in one piece from a suitable metal, e.g. aluminum. The frame 10'' still comprises upstanding side walls, an upstanding end wall, a depending front wall, bottom wall portions bordering such side, rear and front walls, and intermediate walls extending from side to side and/or from front to rear.

The aluminum frame 10, 10', 10'', with the ceramic oven tile 12 installed, is inserted into the oven on top of the wire oven rack 38. The ceramic oven tile 12 provides a very even heat baking surface for the proper preparation of pizza and similar edibles. The oven tile means 12 stops the cheese drip and is easily cleaned. A fifteen-inch pizza, for example, can be cooked in a standard oven. Larger ovens, such as drop ends, can accommodate larger inserts and can therefore cook larger pizza. Camper and motor home-type ovens will usually require a smaller insert.

The embodiments which are illustrated in the drawing, and described above, are presented for example purposes only. The invention is not to be limited by such examples, but only by the following claims, interpreted in accordance with established rules of claim interpretation, including by application of the doctrine of equivalents.

What is claimed is:

1. An oven insert for converting a conventional home oven into a pizza oven, comprising:

a rectangular frame having upstanding sidewalls, an upstanding rear wall, a depending front wall, and bottom wall portions bordering each of said side, rear and front walls, said bottom wall portions comprising bottom support surfaces settable on a wire oven rack, and said front wall depending below the bottom support surfaces an amount greater than the depth of a forward edge portion of the oven rack;

said frame including at least one open area defined by and betwen the bottom wall portions;

ceramic oven tile means supported on said bottom wall portions;

wherein in use the insert is supported on a wire rack in the oven, with the support surfaces of the bottom wall portions of the frame setting on the wire rack, and with the depending front wall of the frame being situated forwardly of a front edge portion of the wire rack, in a position to contact the forward edge and function as a stop, and also depending below the front edge of the rack, in a position to function as a handle.

2. An oven insert according to claim 1, wherein said frame includes an intermediate bottom wall portion extending laterally across the frame at a location between the front and rear bottom wall portions, such intermediate bottom wall portion having an upper surface which is coplanar with the upper surfaces of the other bottom wall portions.

3. An oven insert according to claim 1, wherein said rectangular frame includes an intermediate bottom wall portion extending from the front of the frame to the rear of the frame, at a location between the sides of the frame, such intermediate bottom wall portion having an upper surface which is coplanar with the other bottom wall portions.

4. An oven insert according to claim 1, wherein the ceramic oven tile means comprises a plurality of edge-to-edge placed tile members.

5. An oven insert according to claim 2, wherein the ceramic oven tile means comprises a plurality of edge-to-edge placed tile members.

6. An oven insert according to claim 3, wherein the ceramic oven tile means comprises a plurality of edge-to-edge placed tile members.

7. An oven insert according to claim 1, wherein the rectangular frame comprises angle members at each side, at its front and at its rear, wherein the angle members each have two legs, each leg extending perpendicular to the other leg, wherein one leg of each side angle member is directed inwardly and the other leg is directed upwardly, wherein one leg of the rear angle member is directed inwardly and the other leg is directed upwardly, and wherein one leg of the front angle member is directed inwardly and the other leg is directed downwardly, wherein the inwardly directed legs of the front and rear angle members rest on and are secured to the inwardly directed legs of the side angle members.

8. An oven insert according to claim 7, wherein said frame includes an intermediate bottom wall portion extending laterally across the frame at a location between the front and rear bottom wall portions, such intermediate bottom wall portion having an upper surface which is coplanar with the upper surfaces of the other bottom wall portions.

9. An oven insert according to claim 7, wherein said rectangular frame includes an intermediate bottom wall portion extending from the front of the frame to the rear of the frame, at a location between the sides of the frame, such intermediate bottom wall portion having an upper surface which is coplanar with the other bottom wall portions.

10. An oven insert according to claim 7, wherein the ceramic oven tile means comprises a plurality of edge-to-edge placed tile members.

11. An oven insert according to claim 8, wherein the ceramic oven tile means comprises a plurality of edge-to-edge placed tile members.

12. An oven insert according to claim 9, wherein the ceramic oven tile means comprises a plurality of edge-to-edge placed tile members.

13. An oven insert according to claim 1, wherein said frame is cast from aluminum.

14. An oven insert according to claim 13, wherein the ceramic oven tile means comprises a plurality of edge-to-edge placed tile members.

* * * * *